US007013695B2

(12) United States Patent
Quick et al.

(10) Patent No.: US 7,013,695 B2
(45) Date of Patent: Mar. 21, 2006

(54) METHOD FOR DRAWING CONTINUOUS FIBER

(76) Inventors: Nathaniel R. Quick, 894 Silverado Ct., Lake Mary, FL (US) 32746; Aravinda Kar, 745 S. Lake Claire Cir., Oviedo, FL (US) 32765; Yonggang Li, 12167 Descartes Dr., Orlando, FL (US) 32826; Raymond R. McNeice, 55 Dogwood Trail, Debary, FL (US) 32713

( * ) Notice: Subject to any disclaimer, the term of this patent is extended or adjusted under 35 U.S.C. 154(b) by 5 days.

(21) Appl. No.: 10/828,711

(22) Filed: Apr. 20, 2004

(65) Prior Publication Data

US 2004/0194526 A1 Oct. 7, 2004

Related U.S. Application Data

(62) Division of application No. 09/851,517, filed on May 8, 2001, now Pat. No. 6,732,562.

(60) Provisional application No. 60/203,048, filed on May 9, 2000.

(51) Int. Cl.
*B21D 37/16* (2006.01)

(52) U.S. Cl. ..... 72/342.5; 72/286; 72/288; 72/342.1; 72/364; 72/378; 72/38

(58) Field of Classification Search ..... 72/274, 72/278, 279, 282, 286, 288, 342.1, 342.94, 72/364, 377, 378, 700, 38, 342.5, 342.6
See application file for complete search history.

(56) References Cited

U.S. PATENT DOCUMENTS

| | | | | |
|---|---|---|---|---|
| 3,605,469 | A | | 9/1971 | Queralto |
| 3,788,120 | A | | 1/1974 | Takeo et al. |
| 3,848,319 | A | * | 11/1974 | Hendrickson ..... 29/419.1 |
| 3,854,193 | A | | 12/1974 | Yamaguchi et al. |
| 3,865,564 | A | | 2/1975 | Jaeger et al. |
| 3,943,324 | A | | 3/1976 | Haggerty |
| 3,944,640 | A | | 3/1976 | Haggerty et al. |
| 3,965,328 | A | | 6/1976 | Locke |
| 3,981,705 | A | | 9/1976 | Jaeger et al. |
| 4,043,170 | A | | 8/1977 | Erodi et al. |
| 4,135,902 | A | | 1/1979 | Oehrle |
| 4,142,088 | A | | 2/1979 | Hirsch |
| 4,215,263 | A | | 7/1980 | Grey et al. |
| 4,383,843 | A | | 5/1983 | Iyengar |
| 4,547,650 | A | | 10/1985 | Arditty et al. |
| 4,573,336 | A | * | 3/1986 | Hagglund ..... 72/278 |
| 4,872,923 | A | * | 10/1989 | Borodin ..... 148/598 |
| 4,901,550 | A | | 2/1990 | Koide et al. |
| 4,938,811 | A | * | 7/1990 | Murai et al. ..... 148/595 |

(Continued)

*Primary Examiner*—Ed Tolan
(74) *Attorney, Agent, or Firm*—Frijouf, Rust & Pyle P.A.

(57) ABSTRACT

An apparatus and method is disclosed for drawing continuous metallic wire having a first diameter to a metallic fiber having a reduced second diameter. A feed mechanism moves the wire at a first linear velocity. A laser beam heats a region of the wire to an elevated temperature. A draw mechanism draws the heated wire at a second and greater linear velocity for providing a drawn metallic fiber having the reduced second diameter.

4 Claims, 8 Drawing Sheets

U.S. PATENT DOCUMENTS 4,962,085 A 10/1990 deBarbadillo, II et al.
5,127,364 A 7/1992 Savkar et al.
5,149,681 A * 9/1992 Ohkawa et al. ..... 505/231
5,221,378 A * 6/1993 Nishiura et al. ..... 148/596
5,336,360 A 8/1994 Nordine
5,549,971 A 8/1996 Nordine
5,823,039 A * 10/1998 Umeda et al. ..... 72/286
6,539,154 B1 * 3/2003 Berkey et al. ..... 385/123
6,610,930 B1 * 8/2003 Seuntjens ..... 174/94 R

* cited by examiner

METHOD FOR DRAWING CONTINUOUS FIBER

CROSS-REFERENCE TO RELATED APPLICATIONS

The present application is a division of parent application Ser. No. 09/851,517 filed May 8, 2001 now U.S. Pat. No. 6,732,562 issued May 11, 2004.

This application claims benefit of U.S. Patent Provisional application Ser. No. 60/203,048 filed May 9, 2000. All subject matter set forth in provisional application Ser. No. 60/203,048 is hereby incorporated by reference into the present application as if fully set forth herein.

BACKGROUND OF THE INVENTION

1. Field of the Invention

This invention relates to an apparatus and method for drawing continuous metallic fiber and more particularly to an apparatus and a method for heating and drawing wire for providing a drawn metallic fiber.

2. Description of the Related Art

The art of metal working and metal forming have been well known for a great number of years. Metal may be deformed into various useful shapes by a multitude of apparatuses and methods. One particular form of metal working comprises the working and/or fashioning of metallic wire into fine metallic wire.

Metallic wires and more particularly fine metallic wires have found a wide variety of applications in modern military, industrial and consumer applications. Of the many processes of metal working that have been developed by the prior art, the process of wire drawing is considered one of the preferred processes to produce fine metallic wires. The process of wire drawing has proven to be an effective technique to reduce the diameter of metallic wire. A commercially feasible conventional wire drawing process is capable of producing metallic wire having a diameter of only 100 microns.

In a conventional wire drawing process, a metallic wire is passed through a wire drawing die for reducing the diameter of the metallic wire. In many cases, the metallic wire is passed through a series of wire drawing dies for producing the fine metallic wires. Unfortunately, the production of fine metallic wires by a wire drawing process remains a costly undertaking. In addition, the fine metallic wires may be contaminated by wire drawing dies during the conventional wire drawing process.

The drawing of ductile metallic wire may be accomplished by other drawing processes. One example of a non-conventional wire drawing process comprises the use of a laser to heat the ductile metallic wire. Laser radiation can be focused using a lens system to produce a small spot of high intensity heat energy. The high intensity heat energy may be used for drawing the ductile metallic wire in a non-conventional fashion. The following United States patents are representative of the uses of lasers for heating ductile metallic wire. Many of these United States patents employ complex systems to modify the shape of the laser beam to produce desired heating effects for the production of small diameter wires.

U.S. Pat. No. 3,944,640 to Haggerty et al teaches the method of forming fibers of refractory materials using a focused laser beam and optical system to create a heating zone. The laser beam is split into four beams focused on the refractory material.

U.S. Pat. No. 5,336,360 and U.S. Pat. No. 5,549,971 to Nordine teaches laser assisted fiber growth which includes small diameter fibers of zinc or tungsten of 10 to 170 micrometers. The fiber growth is achieved by movement of a metallurgical microscope stage. The laser beam has a focal point adjusted to coincide with the tip of the growing fiber. Producing an annular laser beam aligned with the axis of the fiber has proved to be an effective though more complex method to control laser energy.

U.S. Pat. No. 3,865,564 to Jaeger et al teaches the drawing of both clad and unclad glass fibers from preform using a laser beam having an annular cross section to soften the preform. The annular laser beam is directed along the axis of the fiber. A modulated control system is also discussed.

U.S. Pat. No. 3,981,705 to Jaeger et al teaches the use of a conical reflector to focus laser radiation in an annular configuration around a glass preform in drawing glass fibers.

U.S. Pat. No. 3,943,324 to Haggerty discloses an apparatus for forming refractory tubing that includes creating a heated zone using a laser. Various optical systems are illustrated for beam splitting and creating annular laser beam configuration.

U.S. Pat. No. 4,135,902 to Oehrle teaches the use of an annular beam to form a melt zone on a fiber using an optical system which includes oscillating galvanometer controlled mirrors, fixed mirror, and a conical reflector to focus the annular laser beam at the surface of the fiber.

U.S. Pat. No. 4,215,263 to Grey et al teaches the use of a rotating reflector, annular mirrors, and a conical reflector to create an annular laser beam heating zone for drawing an optical wave guide wherein the annular laser beam does not intersect the axis of the blank wave guide.

U.S. Pat. No. 4,383,843 to Jyengar suggests use of an annular laser beam as a source for heating a preform from which a light guide fiber is drawn.

U.S. Pat. No. 4,547,650 to Arditty et al discloses an optical system utilizing a laser beam directed towards a spherical mirror then from an ellipsoidal mirror to direct the laser energy in a threadlike annular heating zone.

Although the aforementioned prior art provided a method of fine wire production, these prior art processes did have a major disadvantage and did not fulfill the needs of the wire drawing art.

Therefore, it is an object of the present invention to provide an apparatus and method for drawing continuous metallic fiber that overcomes the disadvantages of the prior art devices and provides a substantial contribution to the wire and metallic fiber production art.

Another object of this invention is to provide an apparatus and method for drawing continuous metallic fiber without the introduction of contaminants into the drawn continuous metallic fiber.

Another object of this invention is to provide an apparatus and method for drawing continuous metallic fiber and capable of accurately producing fine metallic fiber in commercial quantities.

Another object of this invention is to provide an apparatus and method for drawing continuous metallic fiber that is reliable and energy efficient.

Another object of this invention is to provide an apparatus and method for drawing continuous metallic fiber with reduced production costs over the prior art techniques and devices.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an apparatus for drawing a wire having a first diameter to provide a metallic fiber having a reduced second diameter comprising a feed mechanism for moving the wire at a first linear velocity. A laser beam heats a region of the wire and a draw mechanism draws the heated wire at a second linear velocity for providing a metallic fiber having a second diameter.

In a more specific of the invention, the laser beam heats the region of the wire to a visco-elastic temperature. The second linear velocity is greater than the first linear velocity. The feed and the draw mechanisms comprise a feed capstan drive and a draw capstan drive, respectively. The laser beam may comprise a beam splitter for dividing the laser output beam into a first laser beam and a second laser beam for impinging upon a first and a second side of the wire.

A chamber has an entry groove and an exit groove with the wire entering the chamber through the entry groove and with the drawn metallic fiber exiting the chamber through the exit groove. The chamber has a fluid inlet port for receiving a pressurized fluid atmosphere for enveloping the wire. The pressurized fluid atmosphere exits the entry groove and the exit groove for providing a fluid bearing for the wire within the entry groove and for providing a fluid bearing for the drawn metallic fiber within the exit groove. The pressurized fluid atmosphere exits the exit groove for cooling the drawn metallic fiber emanating from the heated region. The chamber has a window substantially transparent to the laser beam for heating the region of the wire within the chamber.

A first and a second sensor sense the first diameter of the wire and the second diameter of the metallic fiber, respectively. A control module is connected to the first and second sensors for controlling the first linear velocity and the second linear velocity for controlling the reduction of the second diameter from the first diameter.

The invention is also incorporated into the method of drawing a wire having a first diameter to a metallic fiber having a second diameter comprising the steps of feeding the wire at a first linear velocity. The wire is heated to a visco-elastic temperature region with a laser. The wire is drawn at second linear velocity to produce the metallic fiber having a reduced second diameter.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
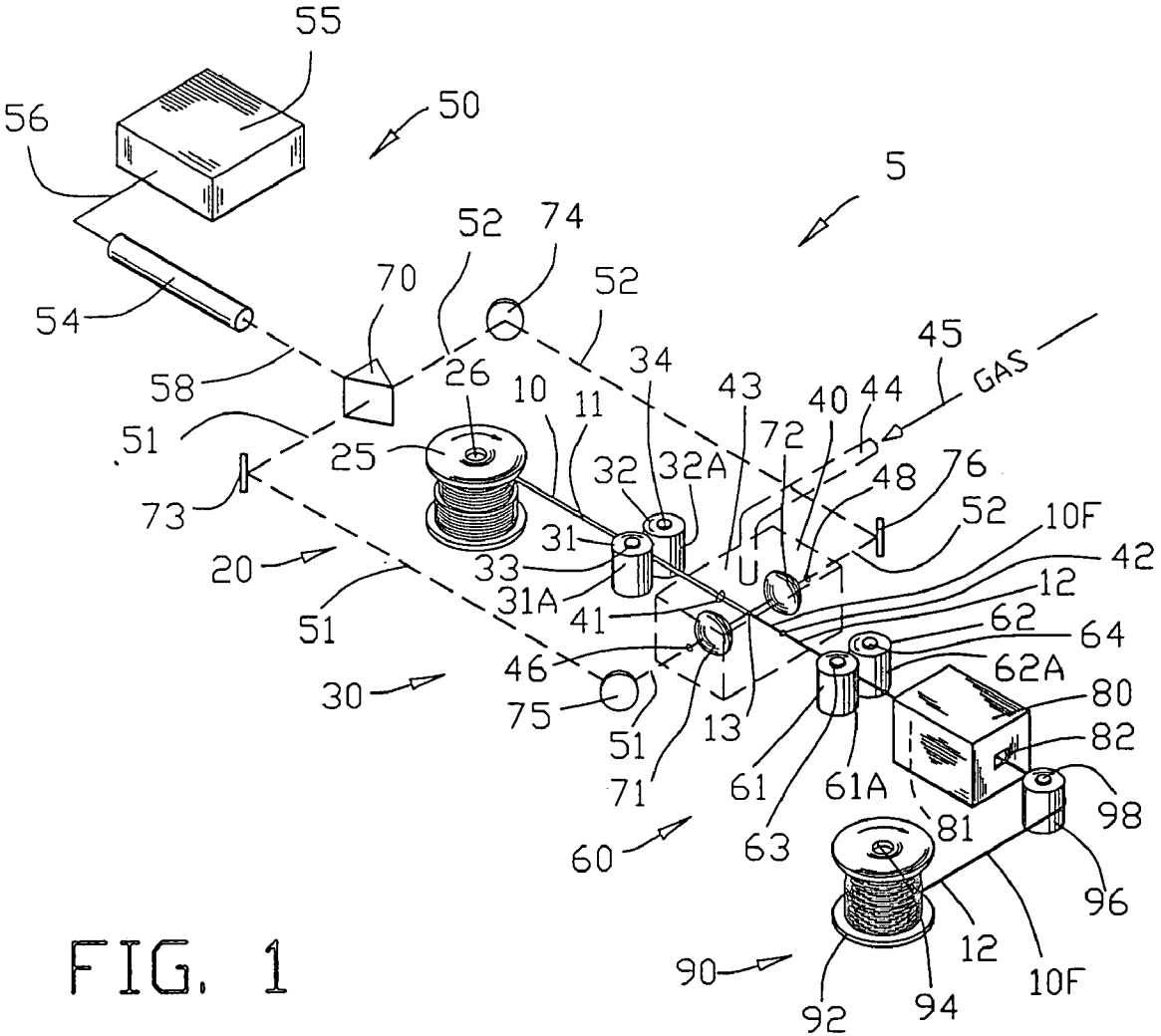
FIG. 1 is an isometric view of a first embodiment of an apparatus for drawing continuous metallic fiber incorporating the present invention.

FIG. 1 is an isometric view of a first embodiment of an apparatus 5 for drawing continuous metallic wire 10 incorporating the present invention. The apparatus 5 transforms the metallic wire 10 having a first diameter 11 into a drawn metallic fiber 10F having a second diameter 12. The apparatus 5 of the present invention is capable of reducing the metallic wires 10 into metallic fiber 10F having less than one-third of the diameter of the metallic wires 10 during a single processing technique. Through the use of multiple processing techniques, the apparatus 5 of the present invention is capable of reducing the metallic wires 10 having the first diameter 11 of 250 microns ($\mu$m) into the drawn metallic fiber 10F having the second diameter 12 of 25 microns ($\mu$m).

The apparatus 5 comprises a wire supply 20 including a feed spool 25 rotatably mounted on a feed spool spindle 26. The feed spool 25 contains a quantity of the wire 10 having the first diameter 11. The feed spool 25 is free to rotate about the feed spool spindle 26 with minimum drag.

A feed mechanism 30 comprises a first and a second feed roller 31 and 32 having first and second cylindrical surfaces 31A and 32A. The first feed roller 31 is driven by a first roller shaft 33 in a clockwise direction (viewed from above). The second feed roller 32 is driven by a second roller shaft 34 in a counterclockwise direction (viewed from above). The first and second feed roller shafts 33 and 34 are driven by a feed motor (not shown) at a constant speed. Preferably, the feed motor (not shown) may be adjusted to vary the rotational speed of the first and second feed rollers 31 and 32.

The metallic wire 10 is threaded between the first and second cylindrical surfaces 31A and 32A of the first and second feed rollers 31 and 32. Preferably, the relative positions of the first and second feed rollers 31 and 32 may be adjusted to ensure proper engagement with the wire 10.

The first and second cylindrical surfaces 31A and 32A engage with the metallic wire 10 to linearly move the wire 10 upon rotation of the first and second feed rollers 31 and 32. The adjustment of the rotational speed of the first and second feed rollers 31 and 32 provides an optimum first linear velocity of the wire 10 through the first and second feed rollers 31 and 32.

The apparatus 5 comprises a chamber 40 having an entry orifice 41 and an exit orifice 42. The chamber 40 defines an interior region 43 interposed between the entry orifice 41 and the exit orifice 42. A fluid inlet port 44 communicates with the chamber 40. Preferably, a fluid 45 is introduced through the fluid inlet port 44 into the chamber 40.

The wire supply 20 feeds the metallic wire 10 into the entry orifice 41 of the chamber 40. The metallic wire 10 passes through the interior region 43 of the chamber 40. The fluid 45 surrounds the metallic wire 10 passing through the interior region 43 of the chamber 40. The chamber 40 defines a first and a second aperture 46 and 48.

A laser system 50 generates a first and a second laser beam 51 and 52 for entering into the interior region 43 of the chamber 40 through the first and second apertures 46 and 48. The first and second laser beams 51 and 52 heat the wire 10 for assisting in the transformation of the wire 10 into the drawn metallic fiber 10F.

A draw mechanism 60 draws the metallic wire 10 to form the drawn metallic fiber 10F. The drawn metallic fiber 10F exits from the exit orifice 42 defined in the chamber 40. The draw mechanism 60 comprises a first and a second draw roller 61 and 62 having first and second cylindrical surfaces 61A and 62A. The first draw roller 61 is driven by a first roller shaft 63 in a clockwise direction (viewed from above). The second draw roller 62 is driven by a second roller shaft 64 in a counterclockwise direction (viewed from above). The first and second feed roller shafts 63 and 64 are driven by a draw motor (not shown) at a constant speed. Preferably, the draw motor (not shown) may be adjusted to vary the rotational speed of the first and second draw rollers 61 and 62.

The drawn metallic fiber 10F is threaded between the first and second cylindrical surfaces 61A and 62A of the first and second draw rollers 61 and 62. Preferably, the relative positions of the first and second draw rollers 61 and 62 may be adjusted to ensure proper engagement with the drawn metallic fiber 10F without slippage.

The first and second cylindrical surfaces 61A and 62A engage the drawn metallic fiber 10F to linearly move the drawn metallic fiber 10F upon rotation of the first and second draw rollers 61 and 62. The adjustment of the rotational speed of the first and second draw rollers 61 and 62 provides an optimum second linear velocity of the drawn metallic fiber 10F through the first and second draw rollers 61 and 62.

The second linear velocity of the drawn metallic fiber 10F through the first and second draw rollers 61 and 62 is adjusted relative to the first linear velocity of the wire 10 through the first and second feed rollers 31 and 32 to ensure the proper drawing of the drawn metallic fiber 10F.

The laser system 50 comprises a laser device 54 powered by a power supply 55 through a connector 56. In this embodiment of the invention, the laser device 54 utilizes a short wavelength of light that will be absorbed by the surface of the metallic wire 10. The specific characteristics of the laser device 54 will be described in greater detail hereinafer.

A laser output beam 58 emanates from the laser device 54 and enters a beam splitter 70. The beam splitter 70 splits the laser output beam 58 into the first and second beams 51 and 52. The first and second beams 51 and 52 exit in opposite directions from the beam splitter 70 and are reflected to a first and a second lens 71 and 72.

The first laser beam 51 is reflected by planar reflectors 73 and 75 toward a chamber 40. The second laser beam 52 is reflected by planar reflectors 74 and 76 toward the chamber 40. The first and second laser beams 51 and 52 enter into the chamber 40 through the first and the second aperture 46 and 48 defined in the chamber 40 to impinge upon the first and second lens 71 and 72. The first and second lenses 71 and 72 are shown mounted internal to the chamber 40. The first and second laser beams 51 and 52 are focused by the first and second lenses 71 and 72 onto a first and a second side of the metallic wire 10 located in the interior region 43 of the chamber 40.

The metallic wire 10 having the first diameter 11 enters the entry orifice 41 of the chamber 40. A region 13 of the metallic wire 10 is heated by the first and second laser beams 51 and 52. The fluid 45 blankets the region 13 of the wire 10 heated by the first and second laser beams 51 and 52. In this example of the invention, the region 13 of the metallic wire 10 is heated to a visco-elastic temperature. The heating of the region 13 of the wire 10 to a visco-elastic temperature enables the metallic wire 10 to be drawn into the drawn metallic fiber 10F without the use of a drawing die.

The first and second draw rollers 61 and 62 operate at the second linear velocity that is greater than the first linear velocity of the first and second feed rollers 31 and 32. The first and second draw rollers 61 and 62 draw the region 13 of the wire 10. The drawing of the region 13 of the wire 10 elongates the wire 10 having the first diameter 11 into the drawn metallic fiber 10F having the second diameter 12. The drawn metallic fiber 10F exits the chamber 40 through exit orifice 42.

The drawn metallic fiber 10F enters an annealing oven 80 through an entry port 81. The drawn metallic fiber 10F passes through the annealing oven 80 and exits from an exit port 82. The drawn metallic fiber 10F is annealed within the annealing oven 80.

A take-up mechanism 90 comprises a take-up spool 92 for receiving the drawn metallic fiber 10F. The take-up spool 92 is rotated by a take up spool shaft 94 driven by take up spool motor (not shown). Preferably, take-up spool 92 is driven to maintain a slight tension on the drawn metallic fiber 10F. A guide roller 96 freely rotates about guide roller spindle 98 to ensure the linearity and orientation of the drawn metallic fiber 10F as the drawn metallic fiber 10F traverses the annealing oven 80.

The relationship between the first linear velocity of the first and second feed rollers 31 and 32 and the second linear velocity of the first and second draw rollers 61 and 62 in conjunction with the heat applied by the first and second laser beams 51 and 52 determine the amount of elongation or drawing of the drawn metallic fiber 10F from the wire 10. This specific relationship will be discussed in greater hereafter.

The fluid 45 within the chamber 40 provides a controlled environment during the heating of the metallic wire 10. The fluid 45 may be a gas or a vapor depending upon any desired chemical reaction to take place within the chamber 40. Preferably, an inert gas is used as the fluid 45 when the chamber 40 is merely used to provide the controlled environment during the heating of the metallic wire 10. The inert gas may be selected from the group consisting of nitrogen, argon or a nitrogen argon mixture. In the alternative, the inert gas may be virtually any inert gas.

A specialized fluid is used as the fluid 45 when the chamber 40 is used to provide a chemical reaction within the chamber 40. The specialized fluid may be a reactive gas, a partially reactive gas, an organic gas or a vapor containing a metal organic compound. The type of metallic wire 10 and the type of specialized fluid 45 is determined by the chemical reaction desired by the user.

Figure 2:
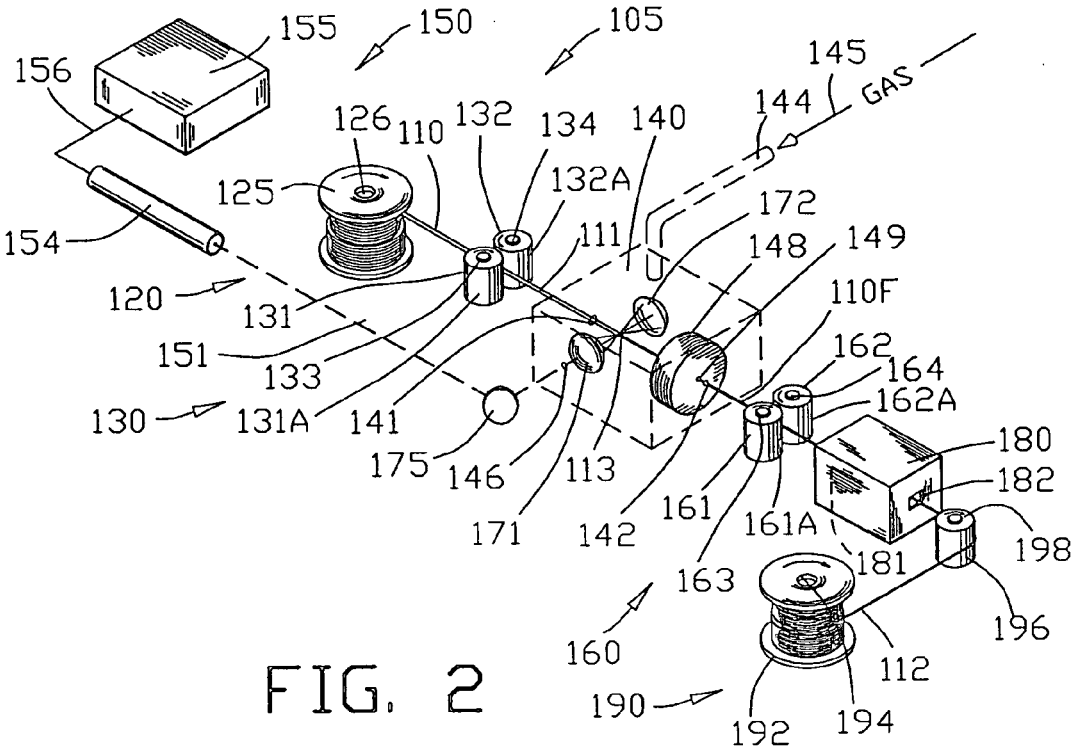
FIG. 2 is an isometric view of a second embodiment of an apparatus for drawing continuous metallic fiber incorporating the present invention.

FIG. 2 is an isometric view of a second embodiment of an apparatus 105 for drawing continuous metallic wire 110 incorporating the present invention. The apparatus 105 comprises a wire supply 120 including a feed spool 125 rotatably mounted on a feed spool spindle 126. The feed spool 125 contains the metallic wire 110 having the first diameter 111.

A feed mechanism 130 comprises a first and a second feed roller 131 and 132 having first and second cylindrical surfaces 131A and 132A. The first and second feed rollers 131 and 132 are driven by a first and a second roller shaft 133 and 134 as set forth previously.

The metallic wire 110 is threaded between the first and second cylindrical surfaces 131A and 132A of the first and second feed rollers 131 and 132 to linearly move the wire 110 upon rotation of the first and second feed rollers 131 and 132 at a first linear velocity.

The apparatus 105 comprises a chamber 140 having an entry orifice 141 and an exit orifice 142. The chamber 140 defines an interior region 143 interposed between the entry orifice 141 and the exit orifice 142. A fluid inlet port 144 communicates with the chamber 140 for introducing a fluid 145 into the chamber 140. The chamber 140 defines an aperture 146.

In this example of the invention, a drawing die 148 is located within the chamber 140. The drawing die 148 comprises a drawing aperture 149 for drawing the metallic wire 110 to form the drawn metallic fiber 110F.

The wire supply 120 feeds the metallic wire 110 into the entry orifice 141 of the chamber 140. The metallic wire 110 passes through the drawing aperture 149 of the drawing die 148 located within the interior region 143 of the chamber 140. The fluid 145 surrounds the metallic wire 110 passing through the interior region 143 of the chamber 140.

A laser system 150 generates a laser beam 151 for heating the wire 110 for assisting in the transformation of the wire 110 into the drawn metallic fiber 110F. The laser system 150 comprises a laser device 154 powered by a power supply 155 through a connector 156. The laser beam 151 emanates from the laser device 154 and is reflected into the chamber 140 through the aperture 146.

The draw mechanism 160 comprises a first and a second draw roller 161 and 162 having first and second cylindrical surfaces 161A and 162A. The first and second draw rollers 161 and 162 are driven by a first and a second roller shaft 163 and 164 as set forth previously.

The metallic drawn metallic fiber 110F is threaded between the first and second cylindrical surfaces 161A and 162A of the first and second draw rollers 161 and 162. The-first and second cylindrical surfaces 161A and 162A engage the drawn metallic fiber 110F to linearly move the drawn metallic fiber 110F upon rotation of the first and second draw rollers 161 and 162 at a second linear velocity. The second linear velocity of the drawn metallic fiber 110F through the first and second draw rollers 161 and 162 is adjusted relative to the first linear velocity of the wire 110 through the first and second feed rollers 131 and 132.

Figure 3:
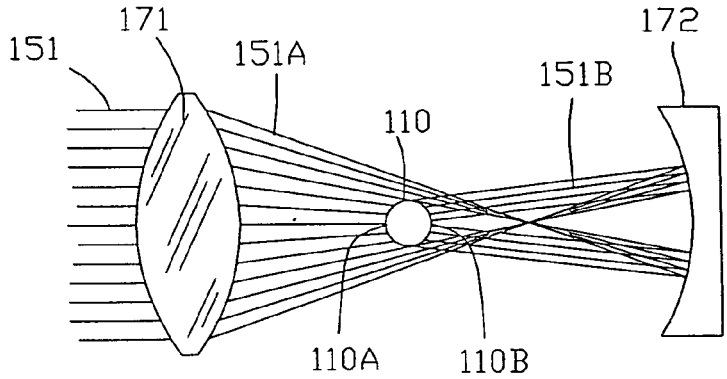
FIG. 3 is an enlarged side view of a parabolic mirror system of FIG. 2.

FIG. 3 is an enlarged side view of a portion of FIG. 2. The laser beam 151 is reflected by a planar reflector 175 through the aperture 146 to a first lens 171 located within the chamber 140. The first lens 171 focuses a first portion 151A of the laser beam 151 onto a first side 110A of the metallic wire 110. A second portion 151B of the laser beam 151 passes along side of the metallic wire 110. The second portion 151B of the laser beam 151 passes above and below the metallic wire 110 and impinges upon a parabolic reflector 172. The parabolic reflector 172 focuses the second laser beam 151B onto a second side 110B of the metallic wire 110.

The metallic wire 110 is heated by the first and second laser beams 151A and 151B focused on the first and second sides 110A and 110B of the wire 110. In this example of the invention, a region 113 of the metallic wire 110 is heated to a temperature sufficient for enabling the drawing die 148 to draw the metallic wire 110 to form the drawn metallic fiber 110F. Preferably, the region 113 of the metallic wire 110 is heated below a visco-elastic temperature.

The first and second draw rollers 161 and 162 operate at a second linear velocity that is greater than the first linear velocity of the first and second feed rollers 131 and 132. The first and second draw rollers 161 and 162 draw the wire 110 through the drawing aperture 149 for drawing die 148. The drawing of the wire 110 through the drawing aperture 149 for drawing die 148 elongates the wire 110 having the first diameter 111 into the drawn metallic fiber 110F having the second diameter 112.

The drawn metallic fiber 110F is annealed in an annealing oven 180 as set forth previously. A take-up mechanism 190 comprises a take-up spool 192 for receiving the drawn metallic fiber 110F from the annealing oven 180.

Figure 4:
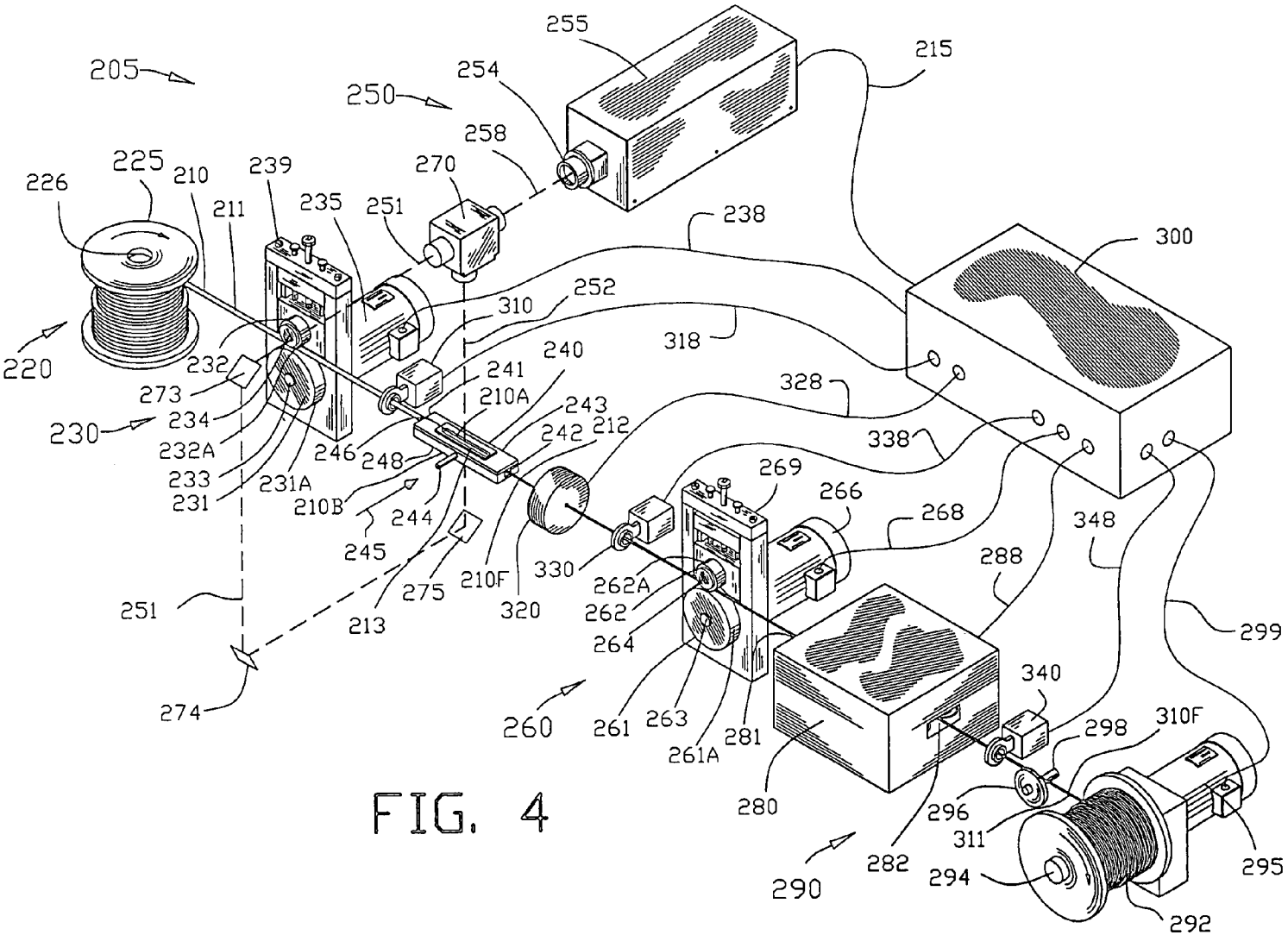
FIG. 4 is an isometric view of a third embodiment of an apparatus for drawing continuous metallic fiber incorporating the present invention.

FIG. 4 is an isometric view of a third embodiment of an apparatus 205 for drawing continuous metallic wire 210 incorporating the present invention. The apparatus 205 transforms the metallic wire 210 having a first diameter 211 into a drawn metallic fiber 210F having a second diameter 212.

The apparatus 205 comprises a wire supply 220 including a feed spool 225 rotatably mounted on a feed spool spindle 226. The feed spool 225 contains a quantity of the wire 210 having the first diameter 211.

A feed mechanism 230 comprises a first and a second feed roller 231 and 232 having first and second cylindrical surfaces 231A and 232A. The first feed roller 231 is driven by a first roller shaft 233 by a feed motor 235. The speed of the feed motor 235 is adjusted by a control module 300 through a control cable 238 to provide optimum first linear velocity as will be further discussed.

The second feed roller 232 is an idler roller being rotatable on a second roller shaft 234. A feed roller tension adjustment 239 is provided to enable optimum tension between first and second feed rollers 231 and 232 for engaging the wire 210 therebetween. The first and second cylindrical surfaces 231A and 232A engaged with the wire 210 to linearly move the wire 210 upon rotation of the first and second feed rollers 231 and 232.

The wire 210 having a first diameter 211 traverses a feed diameter sensor 310 for measuring the first diameter 211 of the wire 210. The feed diameter sensor 310 supplies a signal to the control module 300 through a cable 318 of the measured first diameter 211 of the wire 210.

The apparatus 205 comprises a chamber 240 having an entry orifice 241 and an exit orifice 242. The chamber 240 defines an interior region 243 interposed between the entry orifice 241 and the exit orifice 242. A fluid inlet port 244 communicates with the chamber 240 for introducing a fluid 245 into the chamber 240.

The wire supply 220 feeds the metallic wire 210 into the entry orifice 241 of the chamber 240. The wire 210 passes through the interior region 243 of the chamber 240 with the fluid 245 surrounding the metallic wire 210. The chamber 240 defines a first and a second aperture 246 and 248. The specific structure of the chamber 240 will be described in greater detail hereinafter.

A laser system 250 generates a first and a second laser beam 251 and 252 for entering into the interior region 243 of the chamber 240 through the first and second apertures 246 and 248. The first and second laser beams 251 and 252 heat the wire 210 for assisting in the transformation of the wire 210 into the drawn metallic fiber 210F.

A draw mechanism 260 draws the drawn metallic fiber 210F from the exit orifice 242 defined in the chamber 240. The draw mechanism 260 comprises a first and a second draw roller 261 and 262 having first and second cylindrical surfaces 261A and 262A. The first draw roller 261 is driven by a first roller shaft 263 by a draw motor 266. The speed of the draw motor 266 is adjusted by control module 300 through a control cable 268 to provide optimum second linear velocity as will be further discussed.

The second draw roller 262 is an idler roller being rotatable on a second roller shaft 264. A draw roller tension adjustment 269 is provided to enable optimum tension between first and second draw rollers 261 and 262 for engaging the metallic fiber 210F therebetween. The first and second cylindrical surfaces 261A and 262A engaged with the drawn metallic fiber 210F to linearly move the metallic fiber 210F upon rotation of the first and second draw rollers 261 and 262.

The linear velocity of the drawn metallic fiber 210F through the first and second draw rollers 261 and 262 is adjusted relative to the linear velocity of the wire 210 through the first and second feed rollers 231 and 232 by the control module 300 to ensure the proper drawing of the drawn metallic fiber 210F.

The laser system 250 comprises a laser device 254 powered by a power supply 255. A laser output beam 258 emanates from the laser device 254 and enters a beam splitter 270. The beam splitter 270 splits the laser output beam 258 into the first and second beams 251 and 252. The first beam 251 is reflected toward the chamber 240 by planar reflectors 273–275. The second beam 252 is directed toward the chamber 240. The first and second laser beams 251 and 252 enter into the chamber 240 through the first and second apertures 246 and 248 to impinge upon a first and a second side 210A and 210B of the metallic wire 210 located in the interior region 243 of the chamber 240.

The wire 210 having the first diameter 211 enters the entry orifice 241 of the chamber 240 and a region 213 of the wire 210 is heated to a visco-elastic temperature by the first and second laser beams 251 and 252 focused on the first and second sides 210A and 210B of the wire 210. The fluid 245 blankets the region 213 of the wire 210 heated by the first and second laser beams 251 and 252.

The first and second draw rollers 261 and 262 operate at a second linear velocity that is greater than the first linear velocity of the first and second feed rollers 231 and 232. The drawing of the region 213 of the wire 210 elongates the wire 210 having the first diameter 211 into the drawn metallic fiber 210F having the second diameter 212. The drawn metallic fiber 210F exits the chamber 240 through exit orifice 242.

The drawn metallic fiber 210F enters an optional finishing die 320. The optional finishing die 320 provides a very uniform second diameter 212 to the drawn metallic fiber 210F. In addition, the optional finishing die 320 finishes the surface of the second diameter 212 of the drawn metallic fiber 210F.

The optional finishing die 320 provides additional cooling of the drawn metallic fiber 210F. The mass of the optional finishing die 320 transfers heat from the drawn metallic fiber 210F for substantially reducing the temperature of drawn metallic fiber 210F. Alternately, an independent temperature control and cooling system may be used.

The drawn metallic fiber 210F having the second diameter 212 traverses a second diameter sensor 330 for measuring the second diameter 212 of the metallic fiber 210F. The second diameter sensor 330 supplies a signal to the control module 300 through a cable 338 of the measured second diameter 212 of the metallic fiber 210F.

The drawn metallic fiber 210F enters an annealing oven 280 through an entry port 281. The drawn metallic fiber 210F passes through the annealing oven 280 and exits from an exit port 282.

The drawn metallic fiber 210F is annealed within the annealing oven 280. The temperature of the annealing oven 280 is controlled by the control module 300 through a cable 288. Alternately, an independent temperature control and cooling system may be used.

The annealed drawn metallic fiber 210F having the second diameter 212 traverses a tension sensor 340 for measuring the tension applied to the metallic fiber 210F by a take-up mechanism 290. The tension sensor 340 supplies a signal to the control module 300 through a cable 348 for controlling the take-up mechanism 290.

A take-up mechanism 290 comprises a take-up spool 292 for receiving the drawn metallic fiber 210F. The take-up spool 292 is rotated by a take up spool shaft 294 driven by take up spool motor 295. The spool motor 295 is controlled by the control module 300 through a control cable 299. Preferably, take-up spool 292 is driven to maintain a slight tension on the drawn metallic fiber 210F. A guide roller 296 freely rotates about guide roller spindle 298 to ensure the linearity and orientation of the drawn metallic fiber 210F as the drawn metallic fiber 210F traverses the annealing oven 280.

The relationship between the first linear velocity of the first and second feed rollers 231 and 232 and the second linear velocity of the first and second draw rollers 261 and 262 in conjunction with the heat applied by the first and second laser beams 251 and 252 determine the amount of elongation or drawing of the drawn metallic fiber 210F from the wire 210. This specific relationship will be discussed in greater hereafter.

FIGS. 5–8 are enlarged views of the chamber 240 shown in FIG. 4. The entry orifice 241 and the exit orifice 242 include an elongated entry groove 241G and an elongated exit groove 242G. A fluid inlet port 244 introduces the fluid 245 into the interior region 243 interposed between the entry orifice 241 and the exit orifice 242 of the chamber 240. The fluid 245 provides a positive pressure within the interior region 243 of the chamber 240. The fluid 245 flows through the elongated entry groove 241G to be discharged from the entry orifice 241. Similarly, the fluid 245 flows through the elongated exit groove 242G to be discharged from the exit orifice 242.

The first and second laser beams 251 and 252 enter into the chamber 240 through the first and second apertures 246 and 248. Preferably, the first and second apertures 246 and 248 are covered with a first and a second window 246W and 248W that are substantially transparent to the first and second laser beams 251 and 252. The first and second laser beams 251 and 252 impinge upon the first and second sides 210A and 210B of the metallic wire 210 located in the interior region 243 of the chamber 240.

The wire 210 is heated to a visco-elastic temperature by the first and second laser beams 251 and 252 focused on the first and second sides 210A and 210B of the wire 210. The fluid 245 blankets the region 213 of the wire 210.

Figure 7:
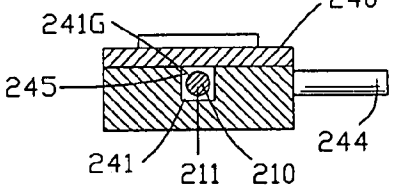
FIG. 7 is a sectional view along line 7—7 in FIG. 5.

The fluid 245 flowing through the elongated entry groove 241G provides a fluid bearing between the wire 210 and the elongated entry groove 241G. The fluid 245 flowing through the elongated entry groove 241G centers the wire 210 within the elongated entry groove 241G as shown in FIG. 7.

Figure 8:
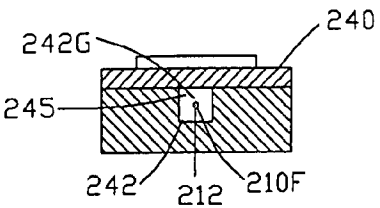
FIG. 8 is a sectional view along line 8—8 in FIG. 5.
Figure 5:
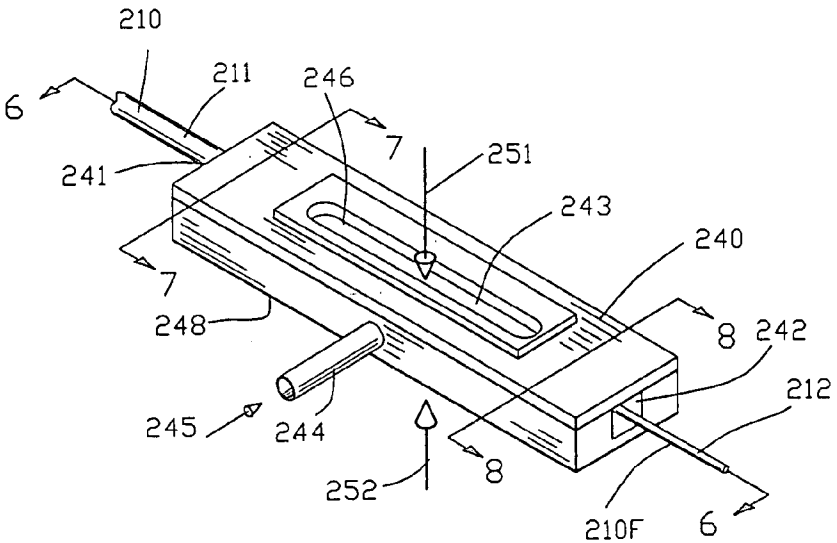
FIG. 5 is an enlarged view of a portion of FIG. 4.
Figure 6:
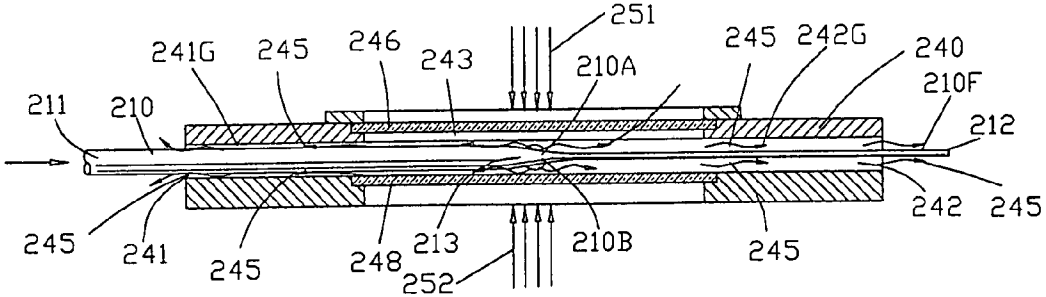
FIG. 6 is a sectional view along line 6—6 in FIG. 5.

The fluid 245 flowing through the elongated exit groove 242G provides a fluid bearing between the drawn metallic fiber 210F and the elongated exit groove 242G. The fluid 245 flowing through the elongated exit groove 242G centers the drawn metallic fiber 210F within the elongated entry groove 242G as shown in FIG. 8.

The fluid 245 flowing through the elongated exit groove 242G cools the drawn metallic fiber 210F within the elongated exit groove 242G. The elongated exit groove 242G acts as a cooling chamber with the cooling being effected by the fluid 245 flowing through the elongated entry groove 241G.

The fluid 245 flowing through the elongated entry groove 241G and the elongated exit groove 242G prevent contact of the metallic wire 210 and/or the metallic fiber 210F with the chamber 240. The non-contact of the metallic wire 210 and/or the metallic fiber 210F with the chamber 240 eliminates the possibility of contamination of the metallic wire 210 and/or the metallic fiber 210F.

Figure 9:
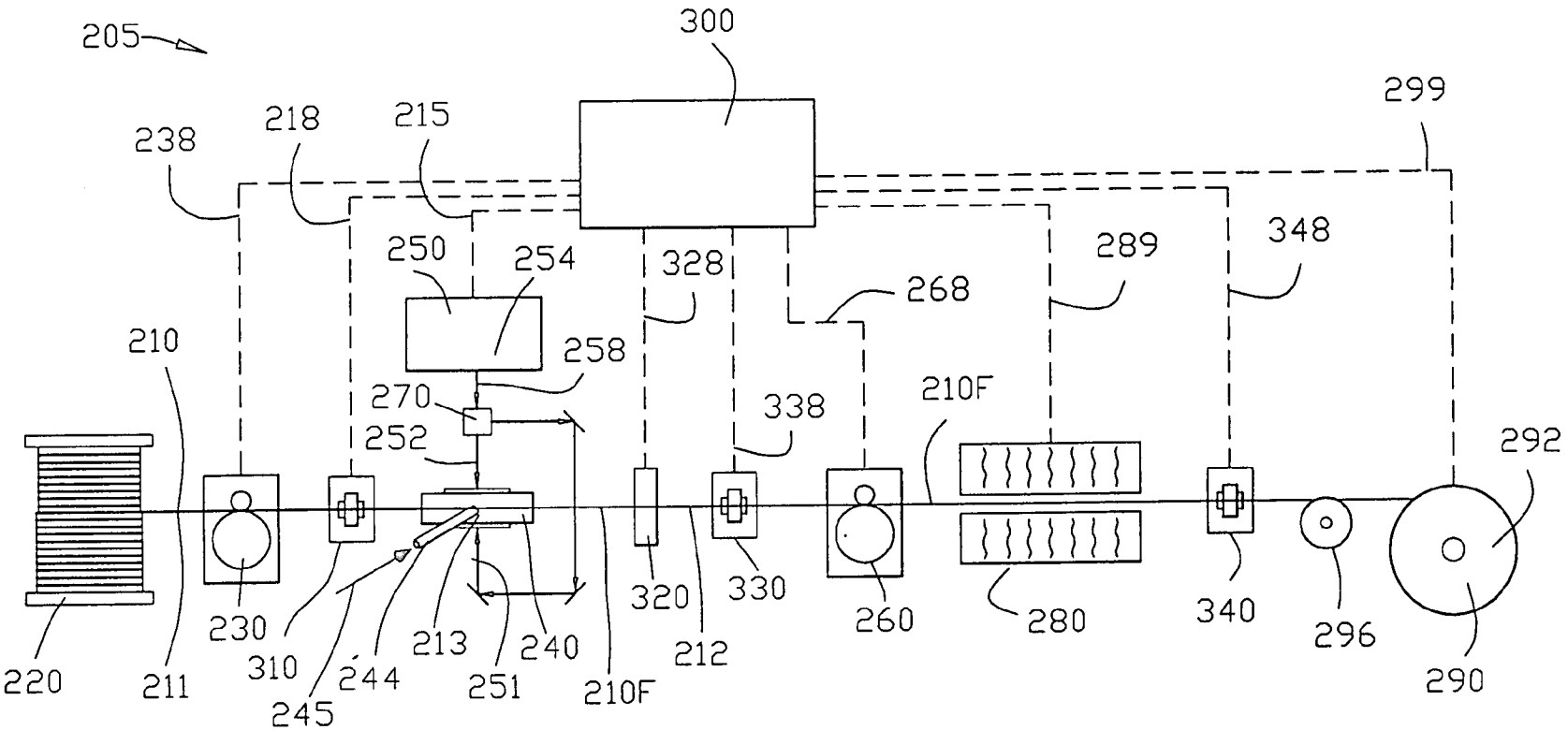
FIG. 9 is a block diagram of the apparatus for drawing continuous metallic fiber illustrated in FIG. 4.
Figure 10:
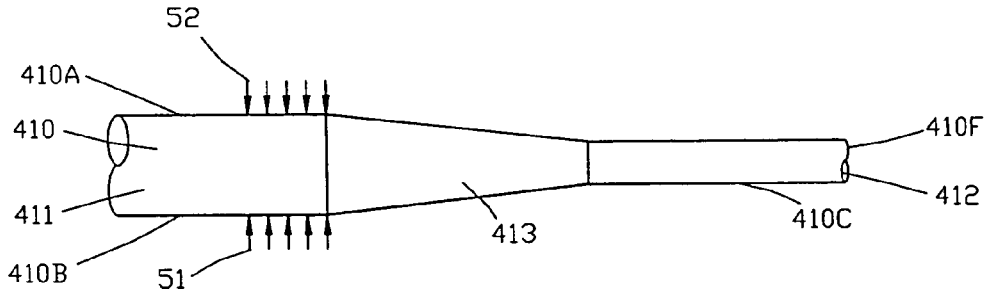
FIG. 10 is a side view of illustrating the transformation of a composite wire into an metallic alloy.
Figure 11:
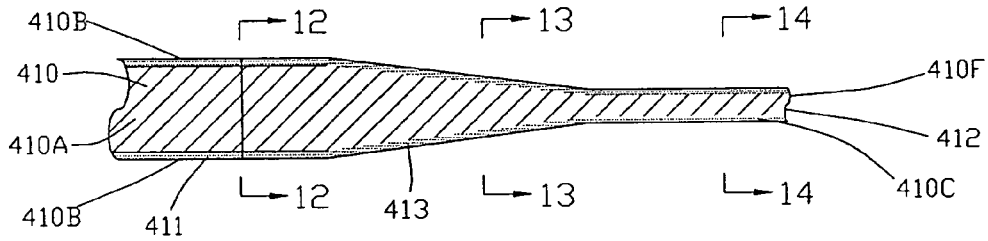
FIG. 11 is a sectional view of FIG. 10.

FIG. 9 illustrates a block diagram of the third embodiment of the apparatus 205 for drawing continuous metallic wire 210 incorporating the present invention. A control module 300 is interfaced to the components of the apparatus 205 as set forth previously.

The wire 210 having the first diameter 211 is pulled from the wire supply 220 by the feed mechanism 230 and fed through the first diameter sensor 310. The control module 300 monitors the first diameter 211 from the first diameter sensor 310.

The wire 210 having a first diameter 211 enters chamber 240 filled with the fluid 245. The laser system 250 heats the region 213 of the wire to a visco-elastic temperature. The output of the laser system 250 is controlled by the control module 300.

The draw mechanism 260 operates at the second linear velocity that is greater than the first linear velocity of the feed mechanism 230. The first and second linear velocities of the feed mechanism 230 and the draw mechanism 260 are controlled by the control module 300. The control of the first and second linear velocities in combination with the control of the output of the laser system 250 controls the elongation or drawing of the metallic fiber 210F from the wire 210.

The drawn metallic fiber 210F enters the annealing oven 280 controlled by the control module 300. The drawn metallic fiber 210 enters the tension sensor 340 for controlling the take-up mechanism 290.

The utilization of the control module 300 interfaced throughout the apparatus 205 enables process optimization by variation of the control module 300 algorithms. Any variables in the wire 210 (raw material) having a first diameter 211 are easily compensated during the process resulting in higher quality continuous metallic fiber 210F (product).

FIGS. 10–14 are various views of illustrating the transformation of a composite wire 410 into an metallic alloy or an intermetallic fiber 410F. The composite wire 410 comprises an inner wire component 410A and an outer component 410B. The outer component 410B may be applied to the inner wire component 410A by electroplating process, a sheathing process, a tube filling process or any other suitable process.

Preferably, an inner wire component 410A is form from a different material then the outer component 410B to form a desired metallic alloy or intermetallic material 410C. The composite wire 410 containing the inner wire component 410A and the outerwear component 410B are transformed by heating and drawing into an metallic fiber 410F having a surface formed from the metallic alloy or intermetallic material 410C.

In this example of the invention, the heating of the region 413 of the composite wire 410 provides two operations that occurring at the time. First, the composite wire 410 is heated to a visco-elastic temperature for allowing the drawing of the composite wire 410 to form the fiber 410F. Second, the composite wire 410 is heated to a temperature to diffuse the outer wire component 410B into the surface of the inner wire component 410A.

The process of forming the metallic alloy or intermetallic material 410C has been illustrated the formation of the alloy material 410C on the surface of the metallic fiber 410F. However, it should be understood that the process may be adapted to provide an interface diffusion or a homogeneous alloy.

Figures 12, 13, 14:
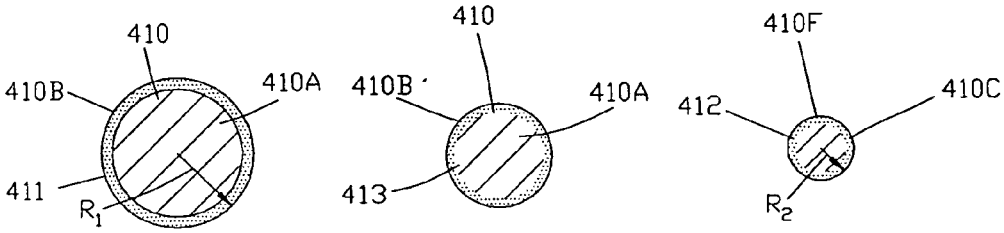
FIG. 12 is a sectional view along line 12—12 in FIG. 11.
FIG. 13 is a sectional view along line 13—13 in FIG. 11.
FIG. 14 is a sectional view along line 14—14 in FIG. 11.

FIG. 12 illustrates the composite wire 410 having a first diameter 411 defines by a radius $R_1$. FIG. 14 illustrates the drawn fiber 410F having a second diameter 412 defines by a radius $R_2$. The radius $R_2$ of the drawn fiber 410F is approximately 0.4 the radius $R_1$ of the composite wire 410.

The cross-sectional area of the composite wire 410 and the drawn fiber 410F may be given by the well known formula:

$$A=\pi R^2$$

where A is the cross-sectional area and R is the radius.

Since the radius $R_2$ of the drawn fiber 410F is approximately one-third the radius $R_1$ of the composite wire 410, the cross-sectional area of the drawn fiber 410F is sixteen percent (16%) the cross-sectional area of the composite wire 410. The process of the present invention provides a substantial savings when the process is application the making metallic fibers of precious metals such as gold, platinum and the like.

Figure 15:
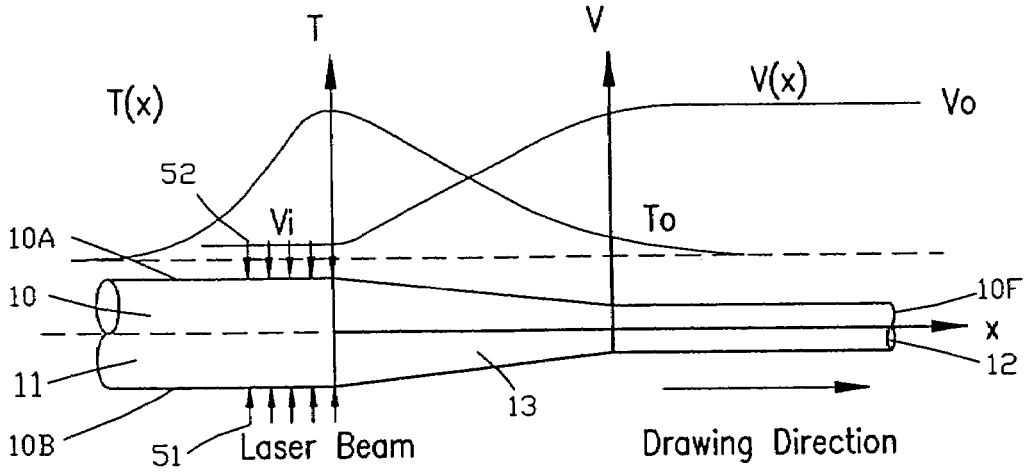
FIG. 15 is a graphical representation of a region of a wire heated by a laser to a visco-elastic temperature.

FIG. 15 illustrates the model geometry for the laser heated metallic fiber drawing process of the present invention. The first and second laser beams 51 and 52 intercept the first and second sides 10A and 10B of the wire 10 having a first diameter 11 to heat the region 13 of the wire 10 to a visco-elastic temperature. The wire 10 having the first diameter 11 is drawn or elongated to provide a metallic fiber 10F having a second diameter 12.

FIG. 15 illustrates the metallic fiber temperature increases to a maximum at T and reduces to $T_0$. The metallic fiber velocity starts at $V_1$ and increases to a final velocity $V_0$. As the visco-elastic temperature reaches a maximum the metallic fiber velocity begins to increase and temperature then begins to decrease. If incident laser power is exclusively utilized to heat the metallic fiber, then the product of the incident laser power and the absorptivity of the metallic fiber determine the maximum velocity achievable in the drawing process. Mass conservation ensures that the metallic fiber diameter is reduced as the square root of the ratio of the constant feed linear metallic fiber velocity to the constant draw linear metallic fiber velocity.

Figure 16:
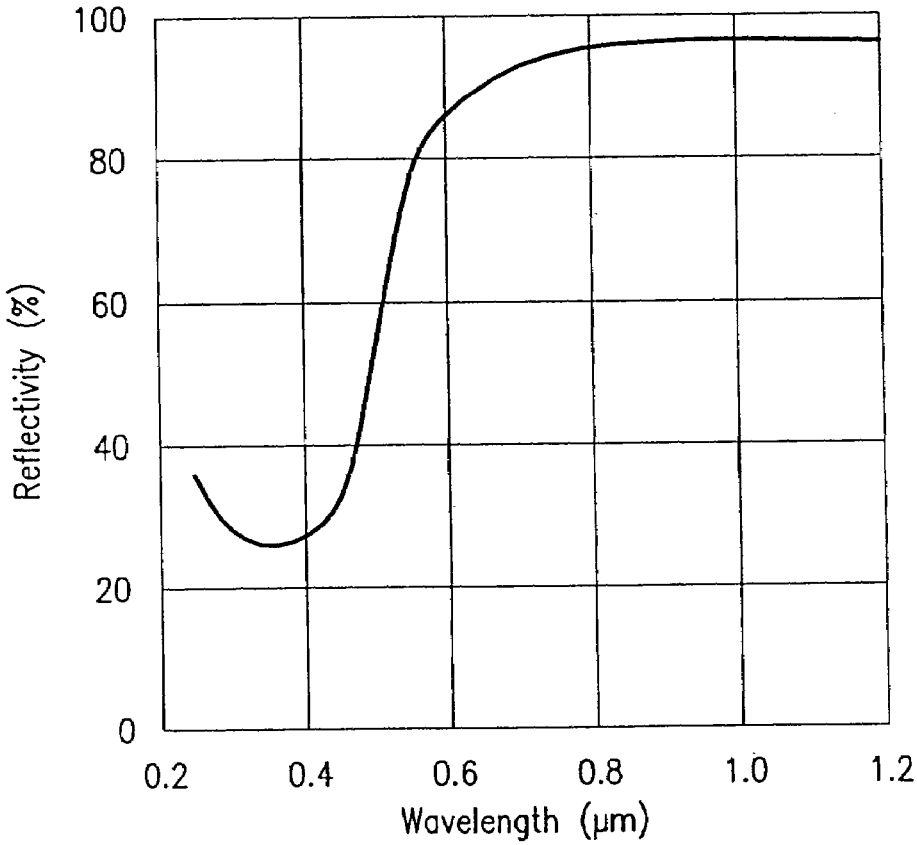
FIG. 16 is a graph illustrating the relationship of a laser wavelength versus the reflectivity of gold.

FIG. 16 illustrates the wavelength vs. percent reflectivity for gold. Absorptivity is strongly dependent on laser wavelength. Gold is highly reflective at wavelengths greater than 600 nm. The highest absorptivity occurs at less than 400 nm (approximately 25 percent reflectivity at 0.4 microns).

Figure 17:
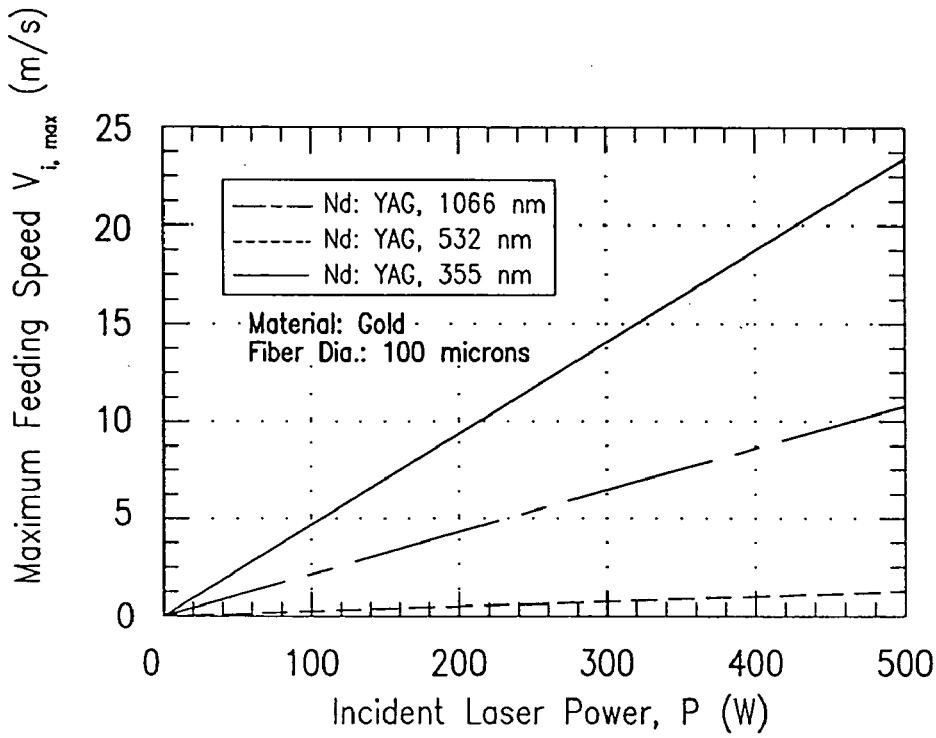
FIG. 17 is a graph illustrating the incident laser power for three distinct wavelengths of lasers versus maximum feeding speed to achieve proper drawing of a regions of a 100 micron gold metallic fiber heated to a visco-elastic temperature.

FIG. 17 illustrates maximum feeding speed in meters per second vs. incident laser power in watts for an Nd:YAG laser, frequency doubled and frequency tripled. The metallic fiber material is gold with a 100 micron diameter. The absorptivity for the Nd:YAG laser (1064 nm) is 3% for frequency doubled (532 nm) absorptivity increase to 32% and for frequency tripled, (355 nm) the absorptivity is 72%.

Figure 18:
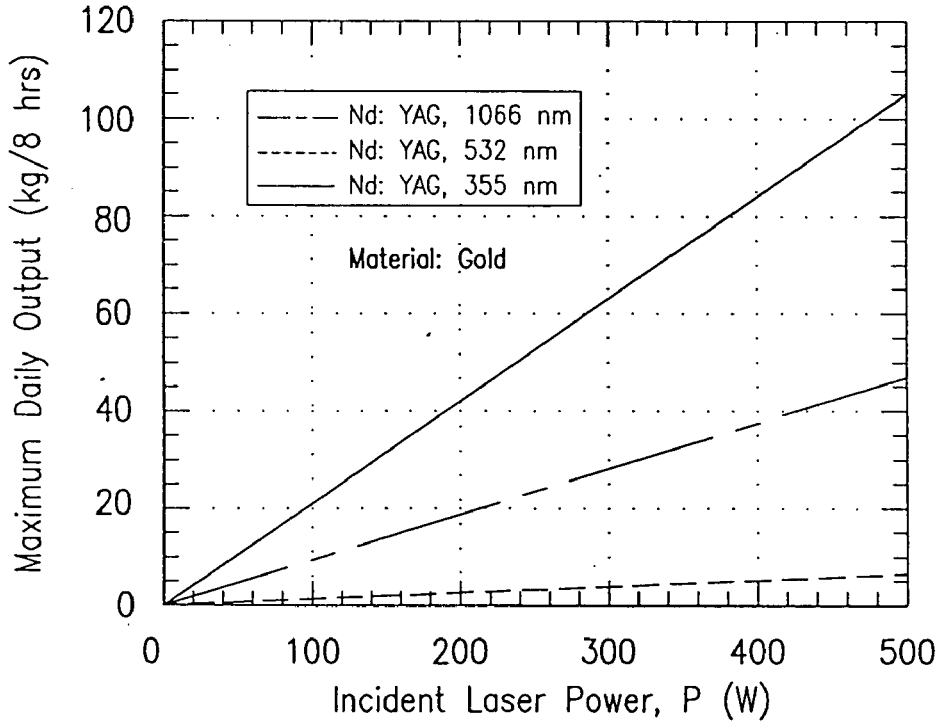
FIG. 18 is a graph illustrating the incident laser power for three distinct wavelengths of lasers versus maximum daily output in kilograms per eight hours gold metallic fiber.

FIG. 18 illustrates the maximum daily output in kg per 8 hours vs. incident laser power in watts. The metallic fiber material is gold and the ND:YAG laser, frequency doubled and frequency tripled are also illustrated. For a frequency tripled Nd:YAG laser processing 100 micron gold metallic fiber, laser powers of 50, 100, and 200 watts would process 10.4, 20.8, and 41.6 kg per 8 hour day.

Preferably, the type of laser is selected on the basis of a wavelength of light that will be absorbed by the surface of the metallic wire 10 or any coating on the surface of a composite metallic wire 410. Conventional lasers such as Nd:YAG, EXCIMER or $CO_2$ lasers may be used with the present invention. Although the laser system has been shown to provide a first and a second laser beam, it should be understood that the apparatus of the present invention may utilize a single laser beam.

EXAMPLE I

The process may be used for ductile metals including gold and gold alloys, platinum and platinum alloys, palladium and palladium alloys, nickel and nickel alloys and iron and iron alloys, titanium and titanium alloys, aluminum and aluminum alloys, copper and copper alloys. The process can also be used to process intermetallics and ceramic surface modified metal metallic fibers. The process also is suitable for rapid proto-typing of metal metallic fiber compositions and ceramic-metal metallic fiber compositions of various sizes and shapes.

EXAMPLE II

The laser metallic fiber process can be used to directly make alloys by diffusion of a surface metal layer into a substrate wire metal concurrent with the deformation by the laser metallic fiber drawing process. In this example, 6–15% by weight Copper electro-plated or clad Nickel wire is prepared. Laser processing in the laser metallic fiber processing apparatus promotes the diffusion of copper into the adjacent nickel region resulting in a 50% by weight Copper-50% by weight Nickel alloy region approaching a Monel like composition. Like compositions are highly corrosion resistant to fluorides.

EXAMPLE III

In another example, a 6% by weight Gold electroplating on Nickel is processed in the apparatus to produce a gold-nickel surface alloy, for example 50% by weight gold and 50% by weight Nickel surface region concurrently with diameter reduction. These compositions provide jewelry optical quality appearance (14 Kt gold) and improve electrical conductivity.

EXAMPLE IV

Intermetallic compositions can be obtained by a controlled conversion where a surface metal is diffused into a substrate wire metal. An aluminum plating, coating or clad is prepared on a nickel substrate. The aluminum diffuses into the nickel surface region concurrently with the composite diameter reduction by the laser metallic fiber drawing process. A 6–15% by weight Aluminum surface layer diffuses into the nickel wire substrate creating, for example, a 50% by weight Aluminum-50% by weight Nickel aluminide intermetallic surface region. Nickel can be replaced by Iron or Titanium to create Iron aluminides and Titanium aluminides.

EXAMPLE V

Wear resistant and electrically conductive ceramic surfaces can be created on metals by the process of the present invention.

Processing titanium wire in a nitrogen atmosphere ($N_2$) within the chamber during the laser heated drawing process creates a titanium nitride (TiN) surface coating that is electrically conductive and wear resistant.

Processing titanium wire in an oxygen atmosphere ($O_2$) within the chamber during the laser heated drawing process creates a titanium oxide (TiO) surface coating.

Processing titanium wire in a methane atmosphere ($CH_4$) within the chamber during the laser heated drawing process creates a titanium carbide (TiC) surface coating.

Processing titanium wire in a diborane atmosphere within the chamber during the laser heated drawing process creates a titanium boride ($TiB_2$) surface coating.

EXAMPLE VI

A small diameter ceramic pipe may be fabricated by the process of the present invention. For example, processing titanium wire in an oxygen atmosphere (O2) within the chamber during the laser heated drawing process creates a titanium oxide (TiO) surface coating. The metallic titanium wire is removed by a chemical or electrochemical process leaving the titanium oxide (TiO) surface coating in the form of a small diameter pipe.

EXAMPLE VII

Various type of metal to metal diffusion can be created with the process of the present invention.

The controlled conversion of a surface metal coating is diffused into a substrate metallic wire. The conversion process may be controlled to provide (1) a surface alloy, or (2) an interface diffusion, or (3) a homogeneous alloy.

In the surface alloy, the surface metal coating is diffused only into the surface of the substrate metallic wire and the interior of the substrate metallic wire remains unchanged.

In the interface diffusion, the surface metal coating is bonded to the substrate metallic wire by diffusion between the surface metal coating and the substrate metallic wire. The exterior of the surface metal coating and the interior of the substrate metallic wire remain unchanged.

In the homogeneous alloy, the surface metal coating is diffused through the substrate metallic wire.

EXAMPLE VIII

Fibers with a catalytic active surface can be created with the process of the present invention.

A surface coating of a catalytic active material may be applied to the surface of a substrate metallic wire. The drawing fiber is formed with a surface coating of the catalytic active material. These catalytic active materials may include Platinum and Cobalt decomposed from metallo-organics during laser radiation.

The present apparatus provides an improved method and apparatus for providing continuous metallic fibers. The process eliminates the need for a bundled drawing and leaching process as required by the prior art. The present apparatus and method produces chemically clean metallic metallic fibers with no contamination. In many examples, the cross-sectional area of the metallic metallic fibers can be reduced by more than 75 percent. Greater reductions may be obtained through the use of multiple or serial processing steps.

The present apparatus provides for the production of continuous metallic fibers made of alloy materials. The process may be used for providing gold, gold alloys, platinum alloys, palladium alloys, stainless-steel and nickel and nickel alloys. The process also is suitable for rapidly prototyping of metallic fibers of various sizes and shapes.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A method of drawing a wire having a first diameter to a fiber having a second diameter, comprising the steps of:

feeding the wire into an entry orifice of a chamber at a first linear velocity;

introducing a pressurized fluid atmosphere into the chamber for enveloping the wire;

heating a region of the wire within an interior region of the chamber with a laser;

drawing the wire at second linear velocity from an exit orifice of the chamber for producing the fiber having a reduced second diameter;

discharging the pressurized fluid atmosphere from the chamber through the entry orifice and the exit orifices for providing an entry and an exit fluid bearing for the wire and the fiber; and cooling the fiber with the pressurized fluid atmosphere discharging from the exit orifice.

2. A method of drawing a precious metal wire having a first diameter to a precious metal fiber having a second diameter, comprising the steps of:

feeding the precious metal wire into an entry orifice of a chamber at a first linear velocity;

introducing a pressurized fluid atmosphere into the chamber for enveloping the precious metal wire;

heating a region of the precious metal wire within an interior region of the chamber with a laser;

drawing the precious metal wire at second linear velocity from an exit orifice of the chamber for producing the precious metal fiber having a reduced second diameter;

discharging the pressurized fluid atmosphere from the chamber through the entry orifice and the exit orifices for providing an entry and an exit fluid bearing for the precious metal wire and the precious metal fiber; and cooling the precious metal fiber within the exit orifice with the pressurized fluid atmosphere discharging from the exit orifice.

3. A method of drawing a gold wire as set forth in claim 2, wherein the step of feeding the gold wire includes feeding the gold wire having the first diameter of approximately one hundred microns; and the step of drawing the gold wire includes drawing the gold wire to have the second diameter of approximately twenty-five microns.

4. A method of drawing a composite wire having an inner wire component and outer wire component defining a first diameter to a metallic fiber alloy having a second diameter, comprising the steps of:

feeding the composite wire into an entry orifice of a chamber at a first linear velocity;

introducing a pressurized fluid atmosphere into the chamber for enveloping the composite wire;

heating a region of the composite wire within an interior region of the chamber for softening the composite wire and for diffusing the outer wire component into the inner wire component;

drawing the composite wire at second linear velocity from an exit orifice of the chamber for producing the metallic fiber alloy having a reduced second diameter;

discharging the pressurized fluid atmosphere from the chamber through the entry orifice and the exit orifices for providing an entry and an exit fluid bearing for the composite wire and the metallic fiber alloy; and cooling the metallic fiber alloy with the pressurized fluid atmosphere discharging from the exit orifice.

* * * * *